US009361868B1

(12) United States Patent
Spriggel

(10) Patent No.: US 9,361,868 B1
(45) Date of Patent: Jun. 7, 2016

(54) CYMBAL STORAGE AND TRANSPORT CONTAINER

(71) Applicant: Daniel John Spriggel, Bermuda Dunes, CA (US)

(72) Inventor: Daniel John Spriggel, Bermuda Dunes, CA (US)

( * ) Notice: Subject to any disclaimer, the term of this patent is extended or adjusted under 35 U.S.C. 154(b) by 0 days.

(21) Appl. No.: 14/544,288

(22) Filed: Dec. 22, 2014

Related U.S. Application Data

(60) Provisional application No. 61/965,019, filed on Jan. 22, 2014.

(51) Int. Cl.
*A45C 11/00* (2006.01)
*G10G 7/00* (2006.01)
*G10D 13/06* (2006.01)

(52) U.S. Cl.
CPC ..... *G10G 7/005* (2013.01); *G10D 13/06* (2013.01)

(58) Field of Classification Search
CPC ..... G10G 7/005; G10G 9/023; A45C 5/00; A45C 7/0059; B65D 85/38; G10D 13/06
USPC ..... 206/314, 303, 304.2, 349, 316.1, 316.2, 206/316.3; 383/38, 40, 114; 84/411 R, 421, 84/453; 150/162, 154, 112, 113, 104, 116; 190/109, 110; 220/528, 529, 530, 532, 220/533, 549, 550, 557
See application file for complete search history.

(56) References Cited

U.S. PATENT DOCUMENTS 5,356,004 A * 10/1994 Weinreb ..... 206/316.2
5,573,114 A * 11/1996 Cyr ..... 206/316.1

* cited by examiner

*Primary Examiner* — Jacob K Ackun
*Assistant Examiner* — Rafael Ortiz
(74) *Attorney, Agent, or Firm* — Jack C. Munro

(57) ABSTRACT

A cymbal storage and transport container which permits cymbals to be stored so they do not contact one another. The cymbals are stored with their centrally located mounting hardware attached which is used to mount each cymbal on a mounting stand. Each mounting hardware is located in the container to not be in contact with any other mounting hardware or cymbal.

3 Claims, 6 Drawing Sheets

CYMBAL STORAGE AND TRANSPORT CONTAINER

BACKGROUND OF THE INVENTION

A hard walled or flexible bag storage container is commonly used by percussionists (drummers) to store and transport cymbals. It is common that after a performance that the cymbals and their mounting hardware are removed from their performing stand and then placed in a storage container. The cymbals are located in the storage container to be able to contact one another which can damage the cymbals which after a period of time require premature replacement of the cymbals. The mounting hardware is typically removed from the cymbals and stored separately which makes such capable of being lost or misplaced for the next performance.

A typical percussionist will utilize five or more cymbals in a performance. To avoid losing or misplacing the mounting hardware, the percussionist will reattach the mounting hardware to the performing stands. This means that the percussionist at the next performance has to remove the mounting hardware and reattach it to the cymbals then mount the cymbals on the performing stands. This procedure is time consuming. If the mounting hardware is kept with the cymbals, the mounting hardware of one cymbal can cause dents and scratches to a directly adjacent cymbal. Scratches and dents in cymbals deteriorate the sound produced from that cymbal. Cymbals are relatively expensive so a drummer wants to keep the cymbal free of dents and scratches for as long as possible extending the time required for replacement.

There have been cymbal mounting hardware that stay with the cymbal during storage and transport after separation from the performing stands. This arrangement makes reassembly with the performing stands quicker and easier. However, leaving the mounting hardware attached to the cymbal during storage and transport without proper isolation and separation from other cymbals will produce a bulky storage container as opposed to a compact container.

SUMMARY OF THE INVENTION

The cymbal storage and transport container of this invention allows for quick, easy and compact storage and transport of multiple cymbals with mounting hardware attached. The cymbal storage and transport container of this invention compactly isolates multiple cymbals with mounting hardware minimizing the volume of the storage space and eliminating damage to the cymbals by a cymbal contacting the mounting hardware of another cymbal. The cymbal storage and transport container of this invention comprises a flexible walled bag that has an interior compartment. There is utilized an assemblage of multiple partitions that is to be inserted within the interior compartment or removed therefrom. The cymbals are staggered so the mounting hardware of one cymbal never aligns with the mounting hardware of a directly adjacent cymbal. The mounting hardware comprises a knob like fastening device mounted in a center hole formed in the cymbal. Each mounting hardware connects with its own slot so there is no way the mounting hardware can physically contact another cymbal.

DETAILED DESCRIPTION OF THE INVENTION

Figure 1:
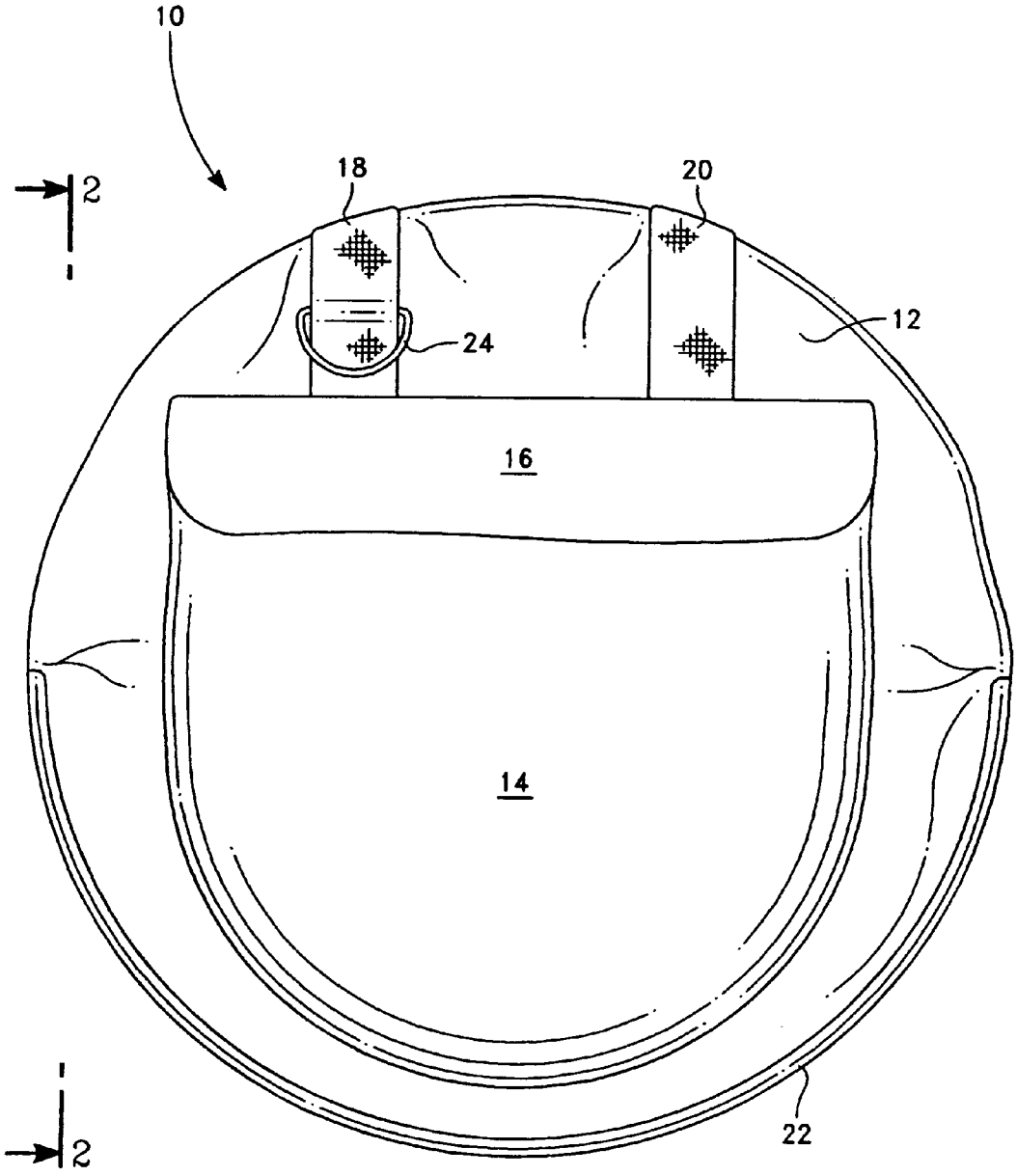
FIG. 1 is a front elevational view of the cymbal storage and transport container of this invention.
Figure 2:
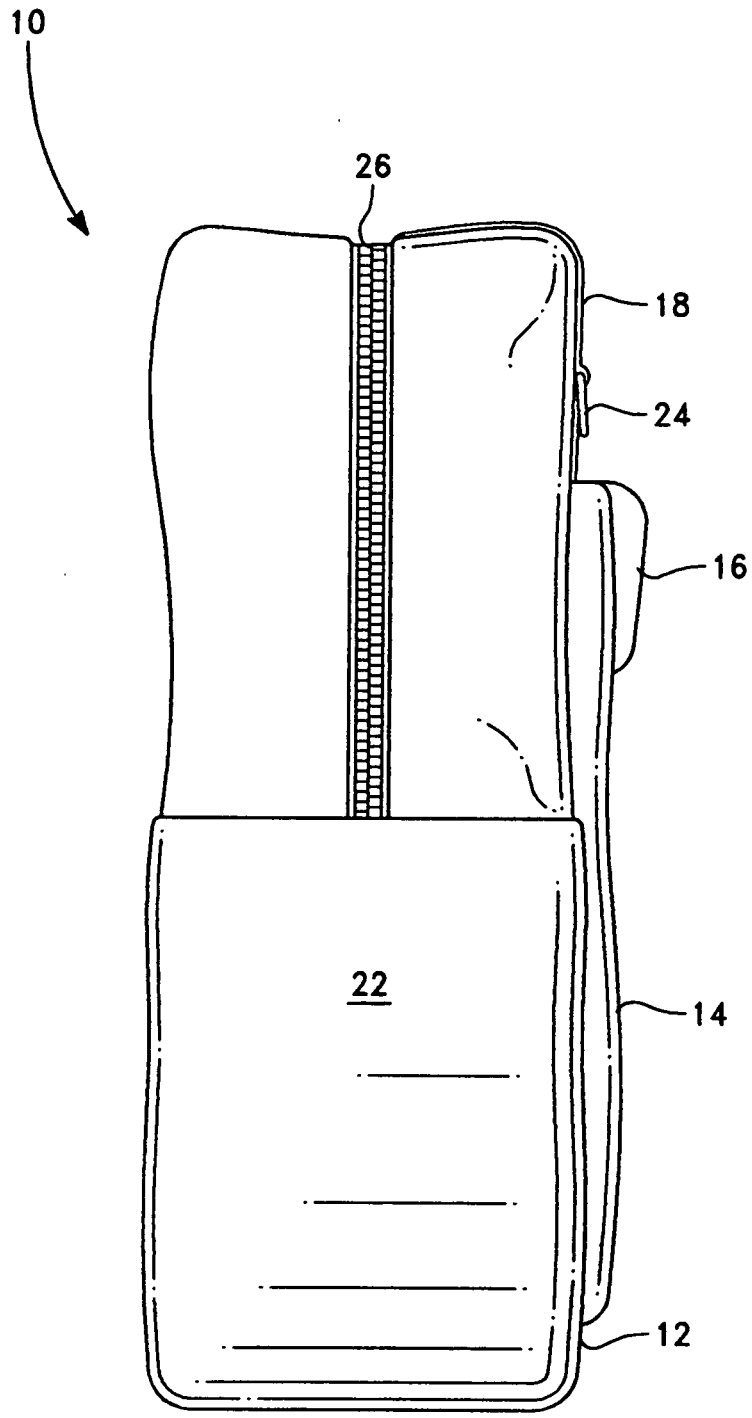
FIG. 2 is a side view taken along line 2-2 of FIG. 1.
Figure 3:
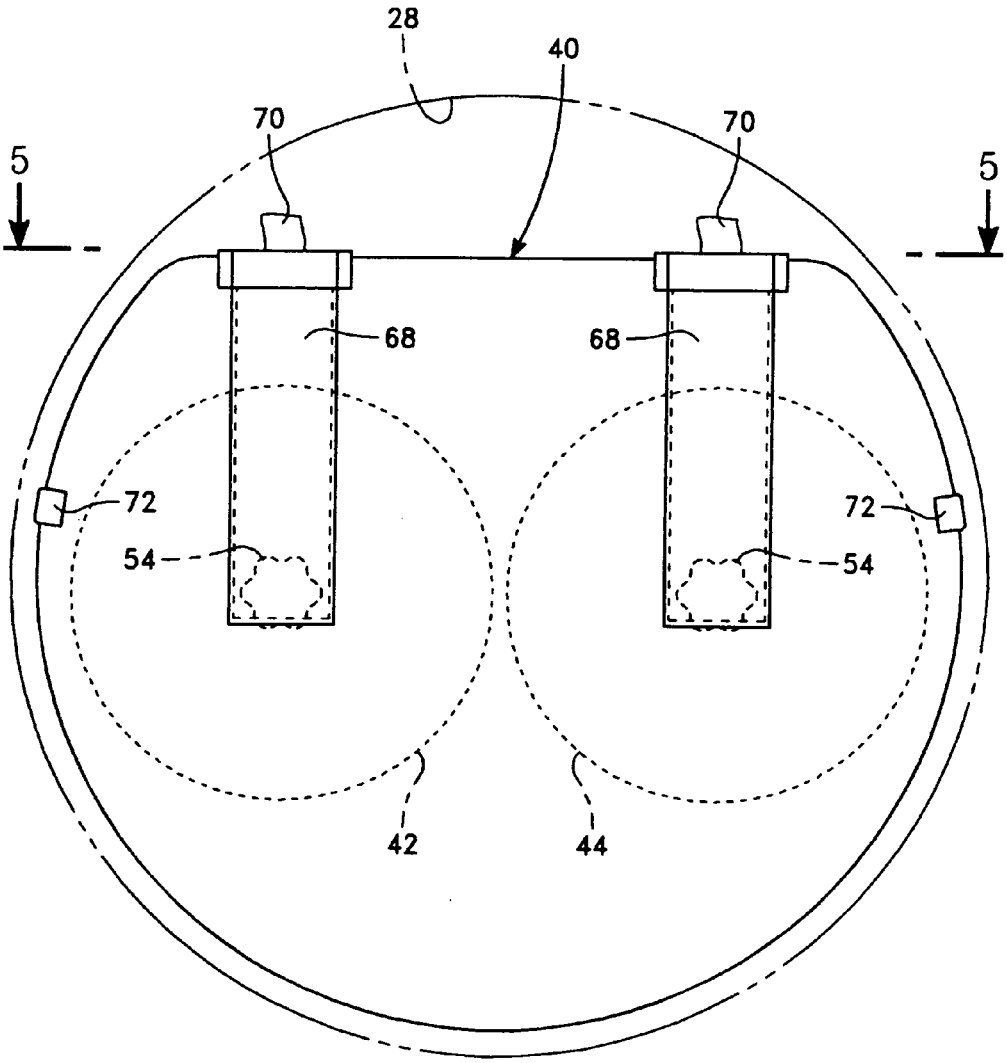
FIG. 3 is a front view of the partition assemblage that is to be installed within the container of this invention.
Figure 4:
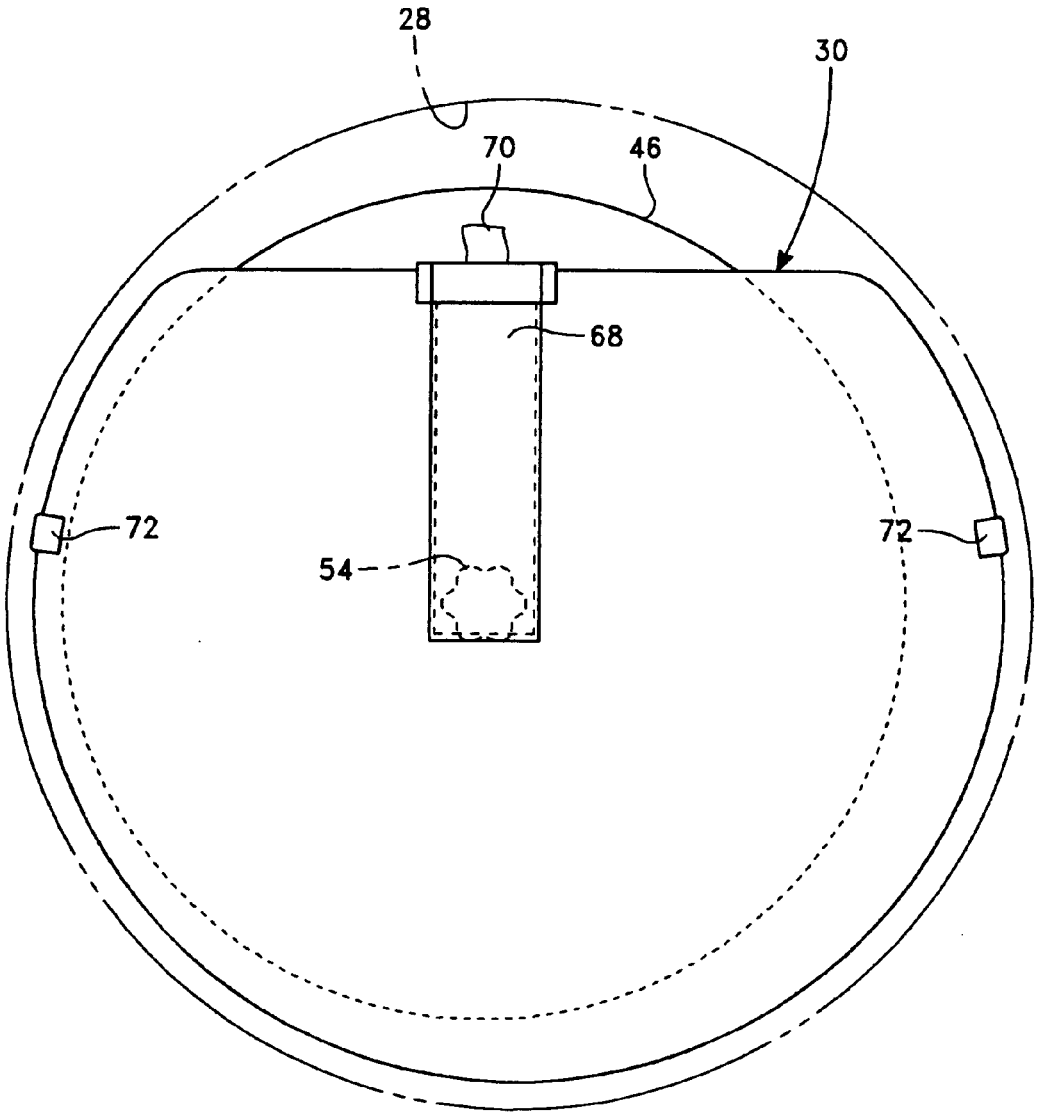
FIG. 4 is a back view of the assemblage of FIG. 3.
Figure 5:
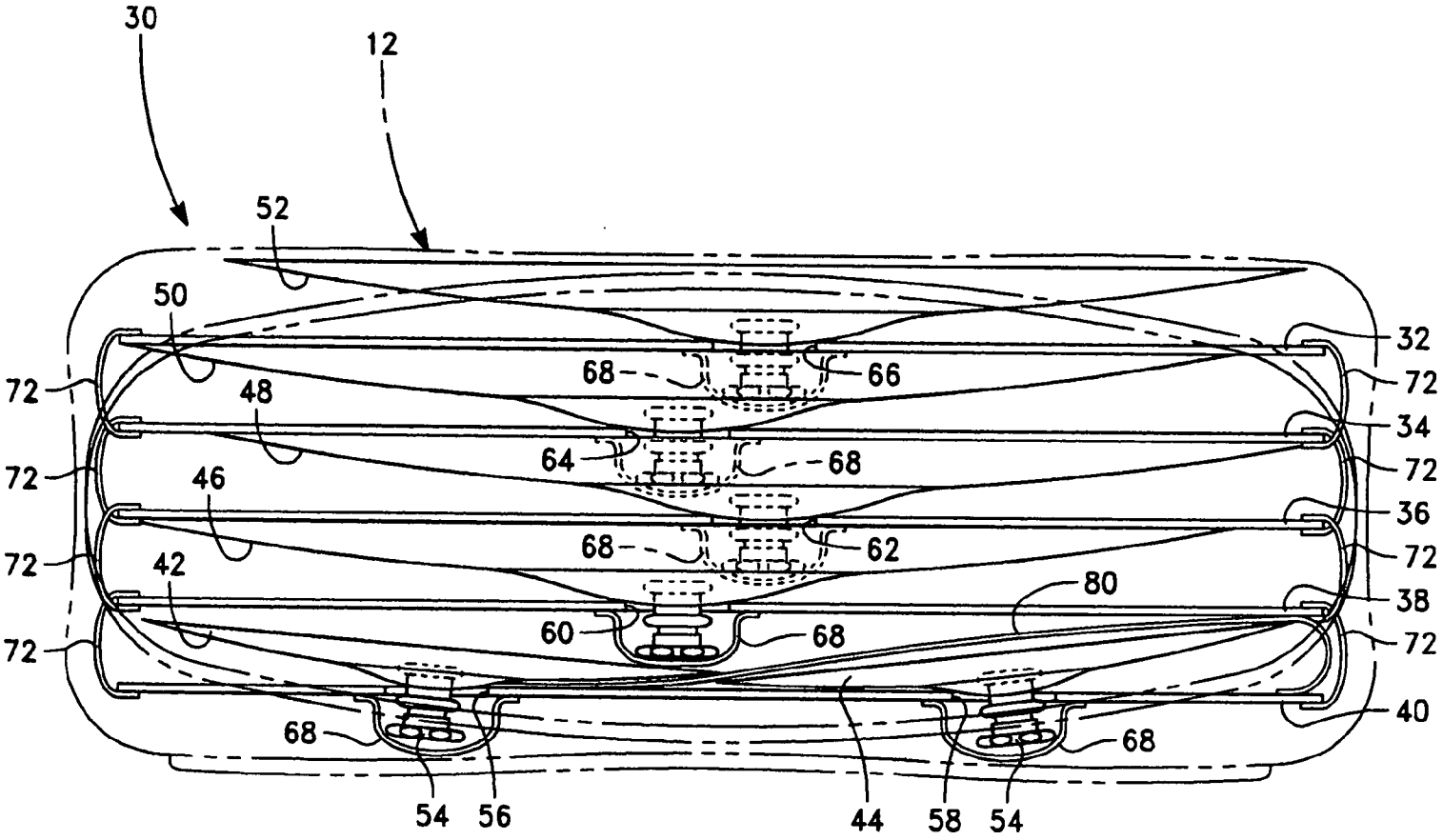
FIG. 5 is a cross sectional view taken along line 5-5 of FIG. 3.
Figure 6:
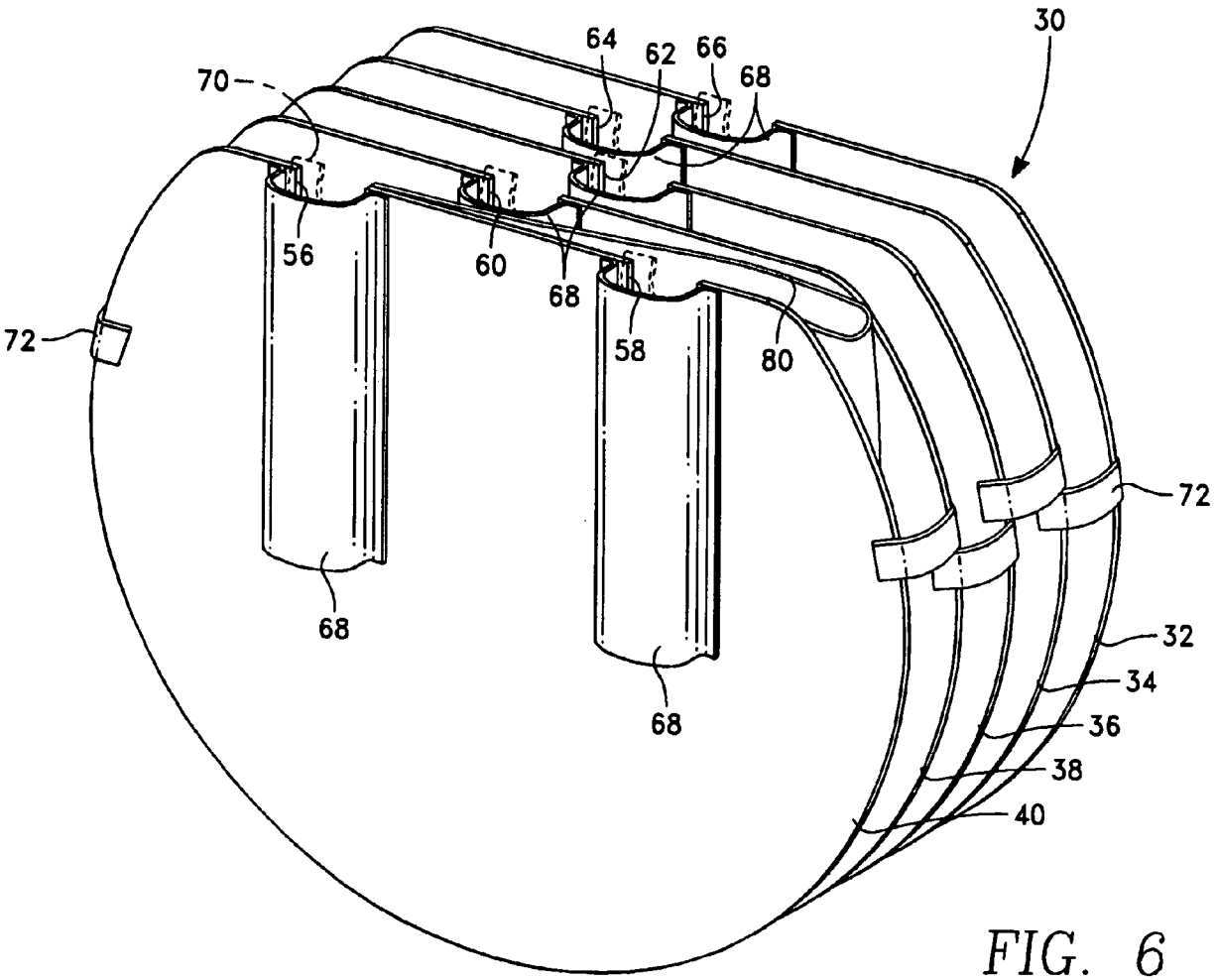
FIG. 6 is a frontal isometric view of the assemblage.

Referring particularly to FIGS. 1 and 2 there is shown the cymbal storage and transport container 10 of this invention. The container 10 is shown to have a flexible fabric exterior wall 12 which is basically in the shape of a disc when viewed from the front. Although a flexible exterior wall is shown the wall could be constructed rigid. The front of the exterior wall 12 has a pocket 14 to hold small articles (not shown). The pocket 14 is to be closable by a closing flap 16. The front also has fixed thereto one end of a pair of support straps 18 and 20. Straps 18 and 20 are spaced a short distance apart. The support straps 18 and 20 are to be used by the human user to facilitate carrying of the container.

The exterior wall 12 includes a thickened bottom layer 22 (plastic or leather) which is to resist wear when the container 10 is deposited on a supporting surface such as a stage or table (not shown). Strip 18 has mounted therein an attaching ring 24. Ring 24 is to connect with a snap (not shown) which is mounted at one end of shoulder strap (not shown) with the opposite end of the shoulder strap being connected to the back side of the container 10. The exterior wall 12 also includes a zipper 26 which when open provides access into the interior compartment 28 of the container 10. Zipper 26 also permits the interior compartment 28 to be closed.

A partition assemblage 30 is shown in FIGS. 3-6 which is to be inserted into the interior compartment 28. The assemblage 30 comprises a first partition 32, a second partition 34, a third partition 36, a fourth partition 38 and a fifth partition 40. Each partition has a rigid paper or plastic core which is covered by a soft cloth material. The soft cloth material protects the cymbals against scratches when placed in the interior compartment 28. The assemblage 30 can be removed from the interior compartment 28 and loaded with cymbals such as small diameter cymbals 42 and 44 and large diameter cymbals 46, 48, 50 and 52. The number of cymbals can be decreased if desired by the drummer. The cymbals 42 to 52 are all constructed in the same manner and only vary in size from three to twenty inches in diameter. Each cymbal is constructed of a metallic material such as brass or steel and includes a center hole within which is located mounting hardware 54. Each cymbal is constructed to have a slightly convex shape on its upper surface. Mounting hardware 54 comprises a nut assembly which is used to mount the cymbal to a performing stand (not shown).

Partition 40 has a pair of parallel and spaced apart slots 56 and 58. Partition 38 has a single slot 60. Partition 36 has a single slot 62. Partition 34 has a single slot 64. Partition 32 has a single slot 66. Each of the slots have a length short of the bottom edge of its respective partition. The slots are all identical in with and length. However, this is not mandatory. The slots are staggered so to be slightly spaced from the slot in their directly adjacent partition (not in alignment). However slots 60 and 64 are in alignment and the same is true for slots 62 and 66.

It is to be noted that cymbals 42 and 44 are small in size such as three to six inches in diameter. Cymbals 46, 48, 50 and 52 are ten to twenty inches in diameter.

Each slot 56 to 66 is to be closed on one side by a strip 68 of loose fabric material. This strip 68 is to keep the mounting hardware 54 from directly contacting a directly adjacent cymbal and prevents scratches or dents from forming. Each strip 68 is secured to its respective partition by a conventional securement such as sewing. The mounting hardware 54 is to engage by sliding with its respective slot 56 to 66. Because the slots 56 to 66 are staggered, the mounting hardware 54 of one cymbal can't come into contact with the mounting hardware of another cymbal.

In order to assist in the removal of the assemblage 30 from the interior compartment 28 there is mounted in conjunction with the upper end of each slot 56 to 66 a small strap 70 which can be grabbed by the drummer and then remove the assemblage 30. The drummer may only need to grab one or two of the small straps 70. There are a plurality of side straps 72 interconnecting each pair of directly adjacent partitions 32 to 40. These side straps 72 permit limited space between directly adjacent partitions so a cymbal(s) can be placed between directly adjacent partitions. These side straps 72 also cause the partitions to assume the single unit referred to as assemblage 30. The assemblage 30 can be removed from the interior compartment 28, loaded with cymbals, and then installed back into interior compartment 28.

On the back side of partition 40 is a cloth flap 80. The cloth flap 80 is sewn onto partition 40. The cloth flap 80 extends from the right hand edge of slot 56 to the right edge of the partition 40. The cloth flap 80 is open at both its top edge and its bottom edge. The use of the cloth flap permits larger cymbals to be installed in the space between partitions 38 and 40 and although a portion of these cymbals overlap, they will not directly contact each other because the cloth flap is located between these cymbals.

The invention claimed is:

1. A cymbal storage and transport container comprising:

an exterior wall having an interior compartment, a plurality of rigid partitions mounted within said interior compartment, said partitions located substantially parallel to each other, each of said partitions having a top edge and a bottom edge and a pair of side edges, one of said partitions having a single slot, said single slot being open at its upper edge of its respective said partition of said partitions and is closed at its bottom by said partition so said slot is spaced from said bottom edge of its respective said partition, said single slot being spaced from said side edges of its respective said partition, whereby a center mounting hardware on a cymbal is adapted to slidingly engage with said single slot; and at least one said partition having a pair of slots located spaced apart and parallel to each other, each of said slots is capable of connecting with a center mounting hardware of a cymbal.

2. The cymbal storage and transport container as defined in claim 1 wherein:

said single slot being oriented in the same manner as said pair of slots and are staggered relative to said pair of slots, so said single slot is not in alignment with either of said pair of slots.

3. A cymbal storage and transport container comprising:

an exterior wall having an interior compartment, a plurality of rigid partitions mounted within said interior compartment, each of said partitions having a top edge and a bottom edge, one of said partitions having a single slot, said single slot being open at its upper edge of its respective partition of said partitions and is closed at its bottom by said partition so said slot is spaced from said bottom edge of its respective said partition, whereby a center mounting hardware on a cymbal is adapted to slidingly engage with said single slot;

at least one said partition having a pair of slots located spaced apart and parallel to each other, each of said slots is capable of connecting with a center mounting hardware of a cymbal; and said partition that has said pair of slots having a cloth flap on one side, said cloth flap permits larger sized cymbals to be installed against said partition and said cloth flap will be located between said larger sized cymbals.

* * * * *